US012606355B2

(12) United States Patent
Yan et al.

(10) Patent No.: US 12,606,355 B2
(45) Date of Patent: Apr. 21, 2026

(54) INSTANT-MIX CAP

(71) Applicant: SHENZHEN GAINSEA TECHNOLOGY CO., LTD., Shenzhen (CN)

(72) Inventors: Minghui Yan, Shenzhen (CN); Wei Wu, Shenzhen (CN); Xiaodong Zheng, Shenzhen (CN); Jie Liao, Shenzhen (CN)

(73) Assignee: SHENZHEN GAINSEA TECHNOLOGY CO., LTD., Shenzhen (CN)

( * ) Notice: Subject to any disclaimer, the term of this patent is extended or adjusted under 35 U.S.C. 154(b) by 18 days.

(21) Appl. No.: 18/766,572

(22) Filed: Jul. 8, 2024

(65) Prior Publication Data

US 2024/0359885 A1 Oct. 31, 2024

Related U.S. Application Data

(63) Continuation of application No. PCT/CN2024/073088, filed on Jan. 18, 2024.

(30) Foreign Application Priority Data

| | | |
|---|---|---|
| Feb. 21, 2023 | (CN) | 202320342636.9 |
| Apr. 6, 2023 | (CN) | 202320738431.2 |
| Aug. 18, 2023 | (CN) | 202322223535.2 |

(51) Int. Cl.

| | |
|---|---|
| ***B65D 81/32*** | (2006.01) |
| ***B65D 25/08*** | (2006.01) |
| ***B65D 51/28*** | (2006.01) |

(52) U.S. Cl.
CPC ..... *B65D 51/2864* (2013.01); *Y10S 215/08* (2013.01)

(58) Field of Classification Search
CPC ..... A47G 19/027; A47J 43/27; A61J 1/2093; A61J 1/201; B65D 51/2864;
(Continued)

(56) References Cited

U.S. PATENT DOCUMENTS

| | | | | |
|---|---|---|---|---|
| 2,653,610 A * | 9/1953 | Smith | B65D 51/2842 604/416 |
| 2,793,776 A * | 5/1957 | Lipari | A61J 9/00 215/11.1 |

(Continued)

FOREIGN PATENT DOCUMENTS

| | | |
|---|---|---|
| CN | 219193128 U | 6/2023 |
| CN | 219822286 U | 10/2023 |
| CN | 220683370 U | 3/2024 |

OTHER PUBLICATIONS https://www.knmsonic.com/energy-director-in-ultrasonic-welding/ (Year: 2025).*

*Primary Examiner* — Gideon R Weinerth

(57) ABSTRACT

The present invention provides an instant-mix cap, which relates to the technical field of the bottle cap. The instant-mix cap includes a cap body and a sealing plug, and the cap body and the sealing plug enclosed to form a sealed storage chamber, a pushing part can drive an elastic part to deform and move downward under the action of an external force, and a pillar simultaneously pushes the sealing plug to move downward, so that the sealing plug is forced to be disconnected from a bottom of a cap cylinder, thereby opening the storage chamber.

8 Claims, 15 Drawing Sheets

(58) Field of Classification Search
CPC ..... B65D 51/2828; B65D 81/3222; B65D 51/2821; B65D 51/2842; Y10S 215/08; Y10S 220/14; B29C 65/08
USPC ..... 206/219; 215/227, 6, DIG. 8; 222/145.5, 222/562
See application file for complete search history.

(56) References Cited

U.S. PATENT DOCUMENTS 3,539,794 A * 11/1970 Kennerly ..... F21K 2/06 252/700
4,024,952 A * 5/1977 Leitz ..... B65D 51/2878 215/DIG. 8
4,701,229 A * 10/1987 Arakawa ..... B29C 65/08 156/580.2
5,401,342 A * 3/1995 Vincent ..... B29C 65/08 264/445
5,520,775 A * 5/1996 Fischl ..... B29C 66/545 425/174.2
5,540,808 A * 7/1996 Vincent ..... B29C 66/112 156/580.2
5,794,802 A * 8/1998 Caola ..... A61J 1/2093 215/11.1
6,257,428 B1 * 7/2001 Caola ..... B65D 81/3222 215/11.1
8,485,353 B2 * 7/2013 Lee ..... B65D 51/2878 215/DIG. 8
8,613,372 B2 * 12/2013 Porter ..... B65D 51/2821 220/521
10,065,775 B2 * 9/2018 Estes ..... B65D 41/3428
10,293,993 B2 * 5/2019 Rohr ..... B65D 41/04
2004/0026270 A1 * 2/2004 Liang ..... B65D 51/2821 206/219
2008/0202949 A1 * 8/2008 Morini ..... B65D 51/285 206/219
2010/0044377 A1 * 2/2010 Porter ..... B65D 51/2828 220/212
2013/0119087 A1 * 5/2013 Owoc ..... B67D 99/00 222/129
2013/0140198 A1 * 6/2013 Rohr ..... B65D 85/00 206/219
2014/0001207 A1 * 1/2014 Dyrbye ..... B65D 51/2864 222/525
2017/0152084 A1 * 6/2017 Giovannini ..... B65D 1/0246
2017/0297779 A1 * 10/2017 Im ..... G01F 19/00
2018/0346221 A1 * 12/2018 Watts ..... B29C 66/12469
2022/0048692 A1 * 2/2022 Chung ..... B65D 85/72
2023/0126929 A1 * 4/2023 Joseph ..... B65D 83/049 206/222
2024/0359885 A1 * 10/2024 Yan ..... B65D 51/28

* cited by examiner

INSTANT-MIX CAP

TECHNICAL FIELD

The present invention relates to a technical field of a bottle cap, and in particular to an instant-mix cap.

BRIEF DESCRIPTION OF THE RELATED ART

Traditional packaged beverages (such as bottled tea beverages) are sold after mixing solute with water. In order to extend the shelf life of the beverage, preservatives and stabilizers are added, which not only affects the taste, but also causes harm to the human body, so the instant-mix cap is coming up, the solute is sealed and stored in the instant-mix cap, which can effectively and stably preserve the activity of various nutrients. When you drink beverages, the solute in the bottle cap is released into the water, which not only can extend a longer shelf life, and the beverages have a fresh taste, the beverages are more in line with the needs of healthy drinks without adding any artificial preservatives.

Existing instant-mix caps usually adopt a structural design of thin wall layer. When drinking, the thin wall layer is pierced or opened, allowing the solute in the storage chamber to flow out and mix with the water in the bottle. This type of design has the following problems:

1. The large difficulty in processing the sealing film or thin wall layer leads to high processing costs. For example, the bonding processing space of the sealing film structure is limited, and the injection molding process of the thin wall layer structure is highly difficult, low-efficiency and has a high production defect rate;
2. The sealing film or thin wall layer has insufficient stability and sealing properties due to its thin structure per se. Firstly, during storage or transportation, the sealing film or thin wall layer is easily damaged, thereby affecting the quality of the encapsulated solute; secondly, the thin wall layer has insufficient sealing properties for oxygen and moisture resistance even if it is not damaged.

SUMMARY OF THE DISCLOSURE

In view of this, the present application proposes out an instant-mix cap to solve the technical problems in the prior art that the thin wall layer structure of the instant-mix cap is difficult to process and the sealing effect is not good.

The technical solution of the present application is implemented as follows:

First Embodiment: the present application provides an instant-mix cap, the instant-mix cap includes a cap body and a sealing plug, the cap body and the sealing plug are enclosed to form a sealed storage chamber.

The cap body includes a pushing part, an elastic part, a protection part, a pillar and a cap cylinder which are integrally formed together, an edge of the pushing part extends outward to form the elastic part, and an edge of the elastic part extends away from the direction of the storage chamber, which forms the protection part; the pillar is provided beneath the pushing part, a lower end of the pillar is engaged with the sealing plug by a snap-fit structure, a top of the cap cylinder is integrally connected with the edge of the elastic part, a bottom of the cap cylinder is open, and is slidably and sealingly connected with the sealing plug to form the storage chamber.

The pushing part can drive the elastic part to deform and move downward under the action of an external force, and the pillar synchronously or simultaneously pushes the sealing plug to move downward, so that the sealing plug is forced to be disconnected from the bottom of the cap cylinder, thereby opening the storage chamber.

Second Embodiment: the present application provides an instant-mix cap which includes an upper cap, a lower cap and a sealing plug; and the upper cap, the lower cap and the sealing plug are enclosed to form a sealed storage chamber.

The upper cap comprises a pushing part, a curved flexible part, an annular protection part, a pillar, an upper cap cylinder and an annular upper snap-in part which are integrally formed, the annular protection part protrudes upward and encloses to form a protection area which is used for accommodating the pushing part and the curved flexible part, and a height of the annular protection part is larger than a height of the pushing part; the sealing plug is removably sealingly connected to a bottom of the lower cap for sealing the storage chamber; the pillar is integrally provided beneath the pushing part of the upper cap, and its lower end is fixedly connected to the sealing plug; when manually acting downward on the pushing part, the curved flexible part deforms and moves downward, and the pillar synchronously or simultaneously pushes downward the sealing plug, which causes the sealing plug to escape from blocking of a lower cap cylinder, thereby opening the storage chamber.

Third Embodiment: the present application provides an instant-mix cap, it includes an upper cap, a lower cap and a sealing plug, the upper cap, the lower cap and the sealing plug are enclosed to form a sealed storage chamber, wherein:

The upper cap includes a pushing part, an elastic part, a protection part, an upper cap cylinder and a pillar which are integrally formed, and an edge of the pushing part extends outward and forms the elastic part, an edge of the elastic part extends away from the direction of the storage chamber, which protrudes and forms the protection part, a height of the protection part is larger than a height of the pushing part; the pillar is provided beneath the pushing part, a lower end of the pillar is engaged with the sealing plug, an inner side of the edge of the protection part extends toward the direction of the storage chamber to form the upper cap cylinder.

The lower cap includes a lower cap cylinder and a lower cap housing. The lower cap cylinder is integrally covered onto the lower cap housing, a bottom of the lower cap cylinder is engaged with the sealing plug; an inner sidewall of the lower cap housing is connected to an outer sidewall of the upper cap cylinder, a top surface of the lower cap housing is abutted against a bottom surface of the protection part, and they are sealed and connected by ultrasonic welding at their connection.

The pushing part can drive the elastic part to deform and move downward under the action of the external force, and the pillar simultaneously or synchronously pushes the sealing plug to move downward, causing the sealing plug break the connection with the bottom of the lower cap cylinder, thereby opening the storage chamber.

DETAILED DESCRIPTION OF EXEMPLARY EMBODIMENTS

First Embodiment

Figure 1:
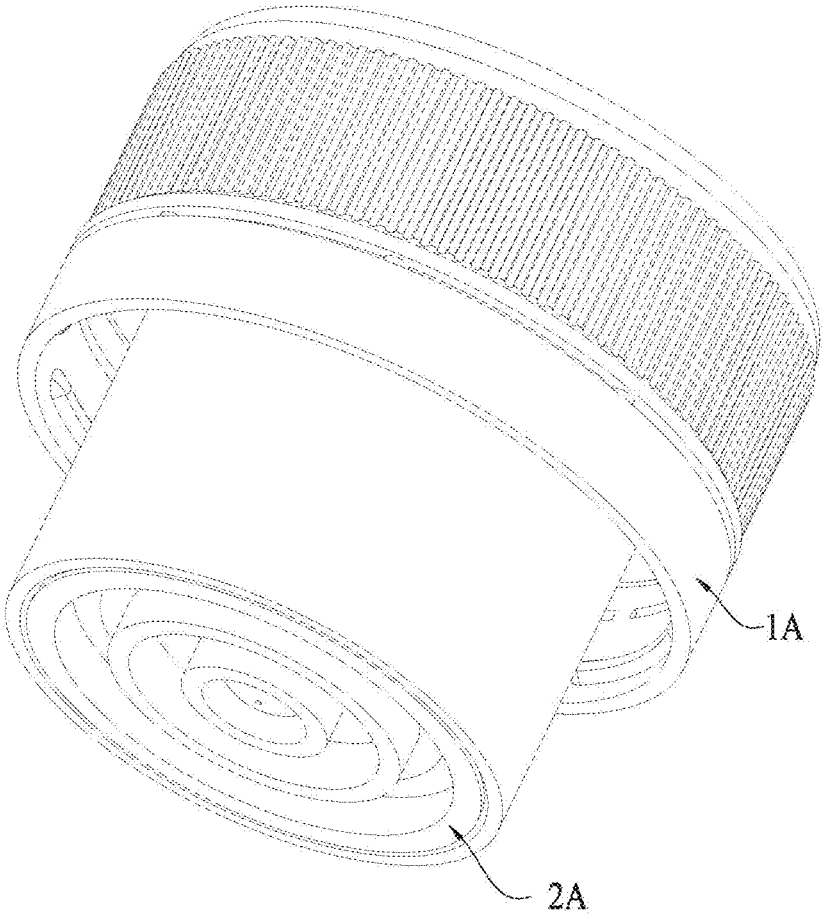
FIG. 1 is a stereo diagram of an instant-mix cap in accordance with the first embodiment of the present invention.
Figure 2:
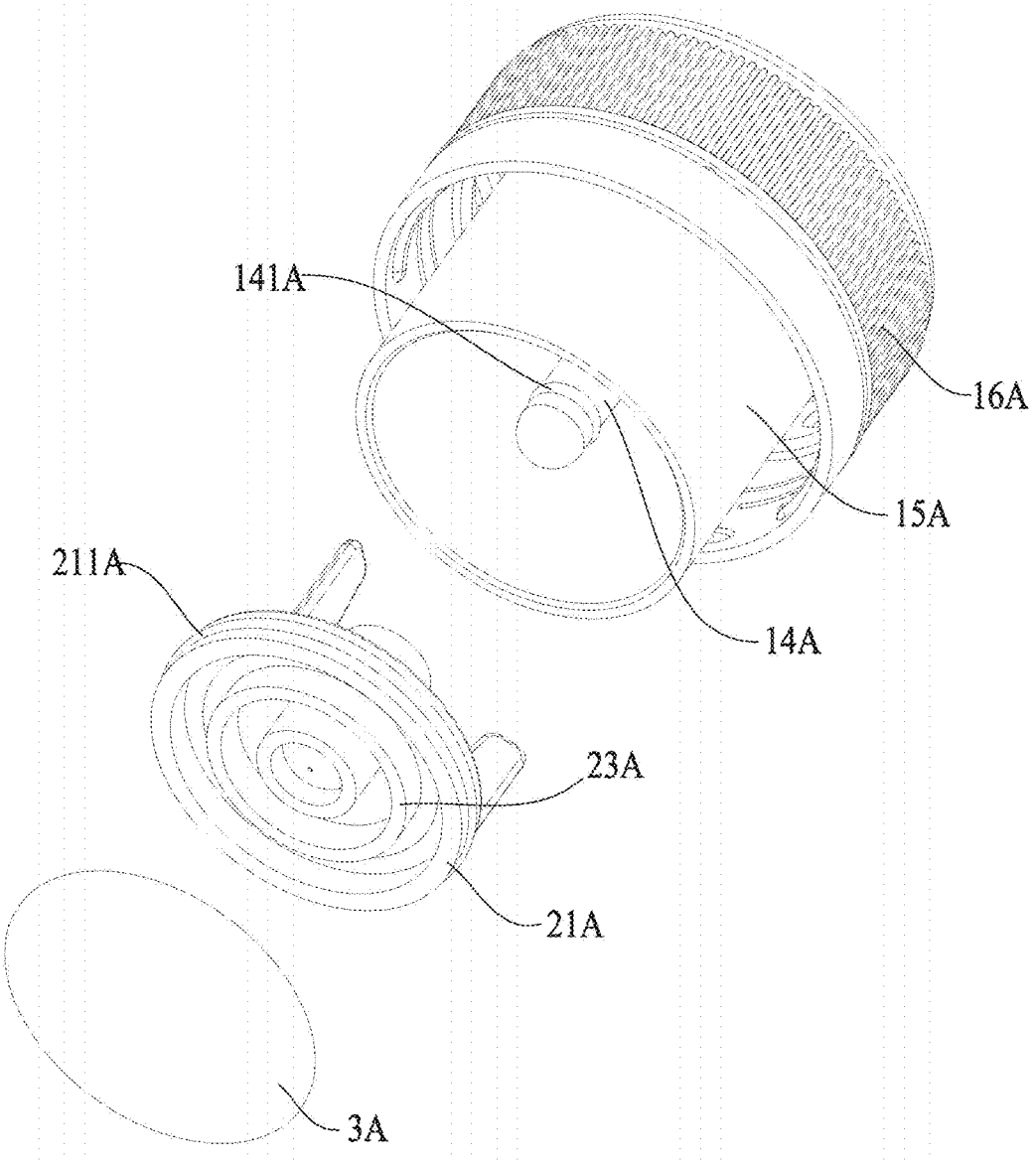
FIG. 2 is a first perspective exploded diagram of the instant-mix cap in accordance with the first embodiment.
Figure 3:
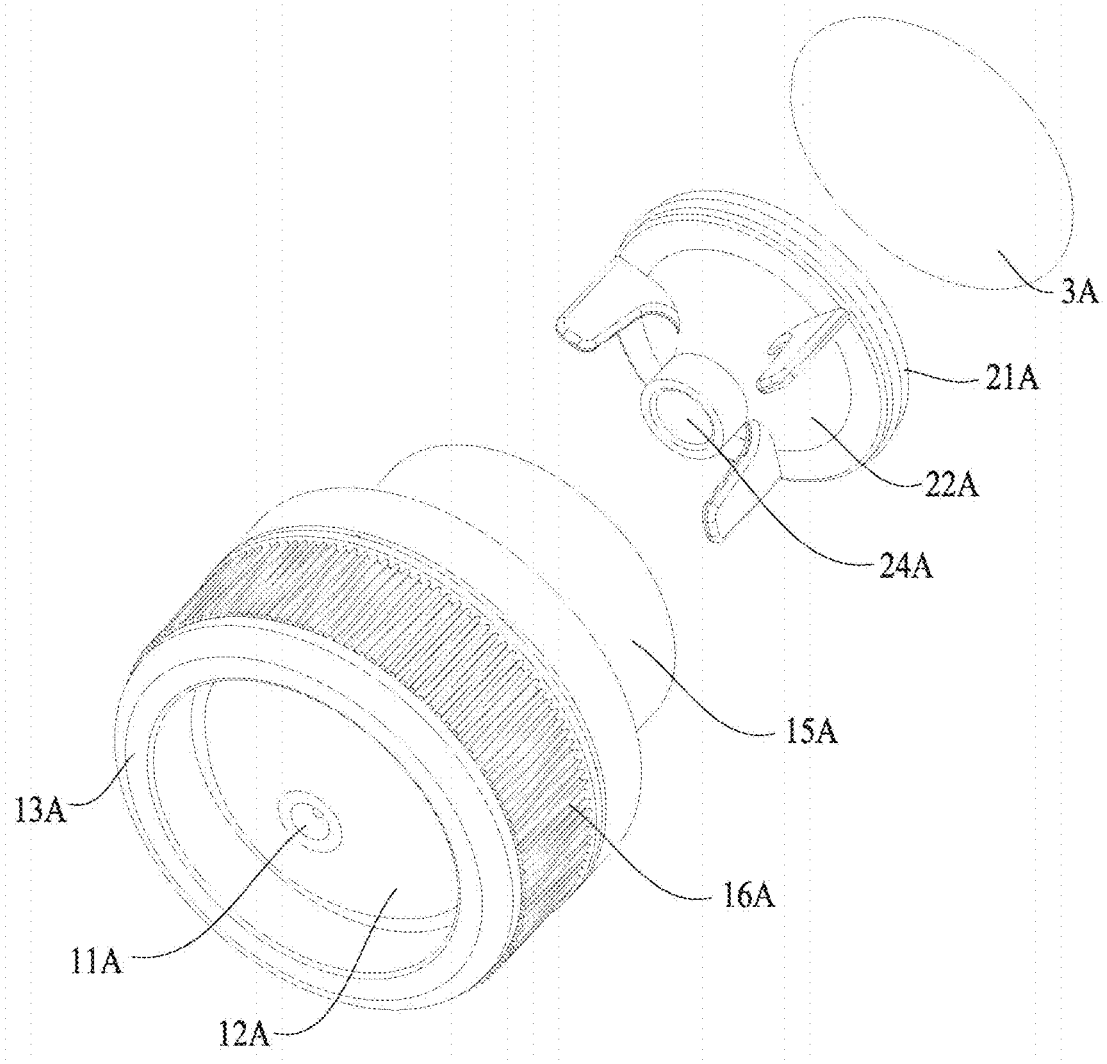
FIG. 3 is a second perspective exploded diagram of the instant-mix cap in accordance with the first embodiment.
Figure 4:
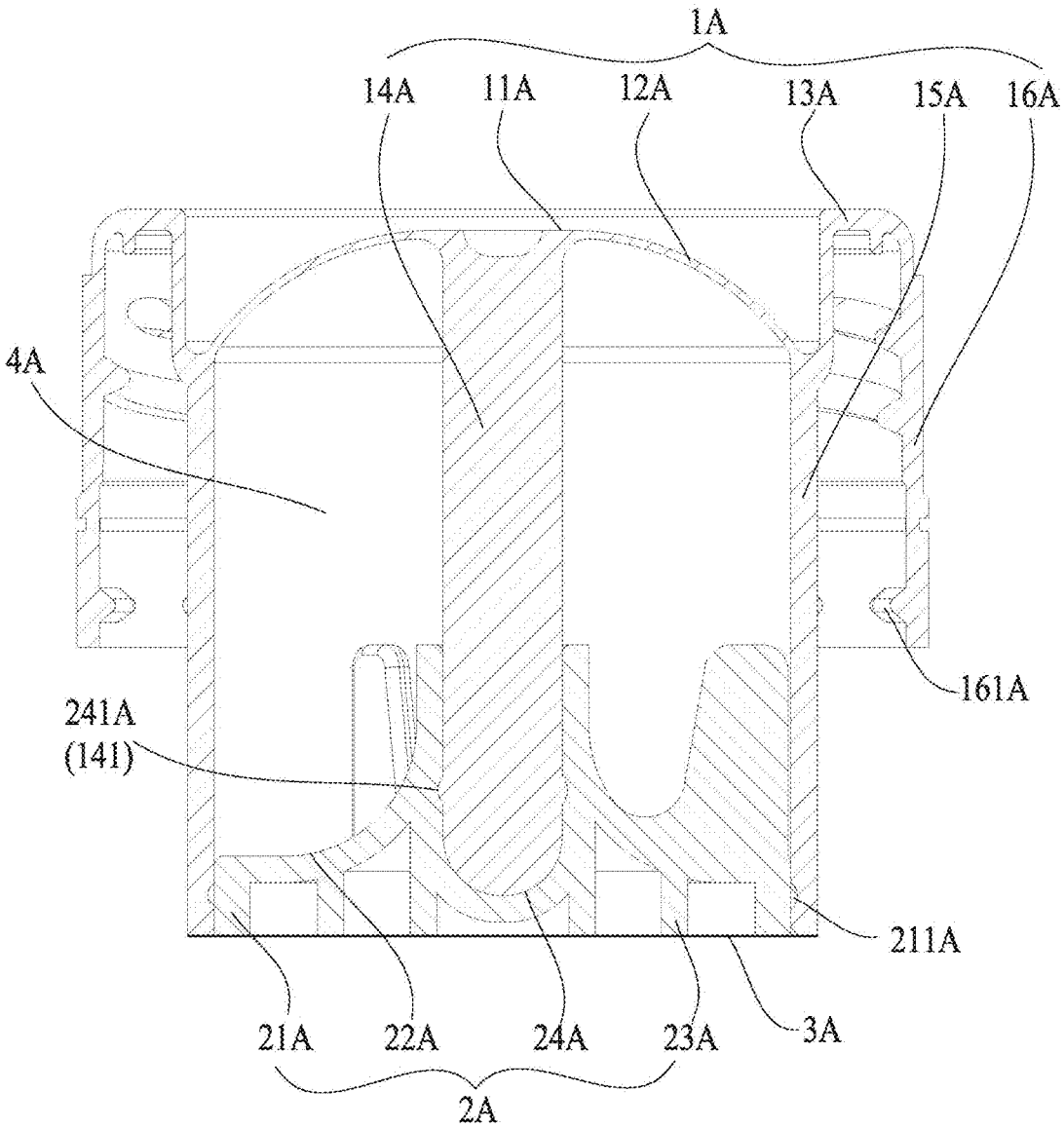
FIG. 4 is a cross-sectional diagram of the instant-mix cap in accordance with the first embodiment.
Figure 5:
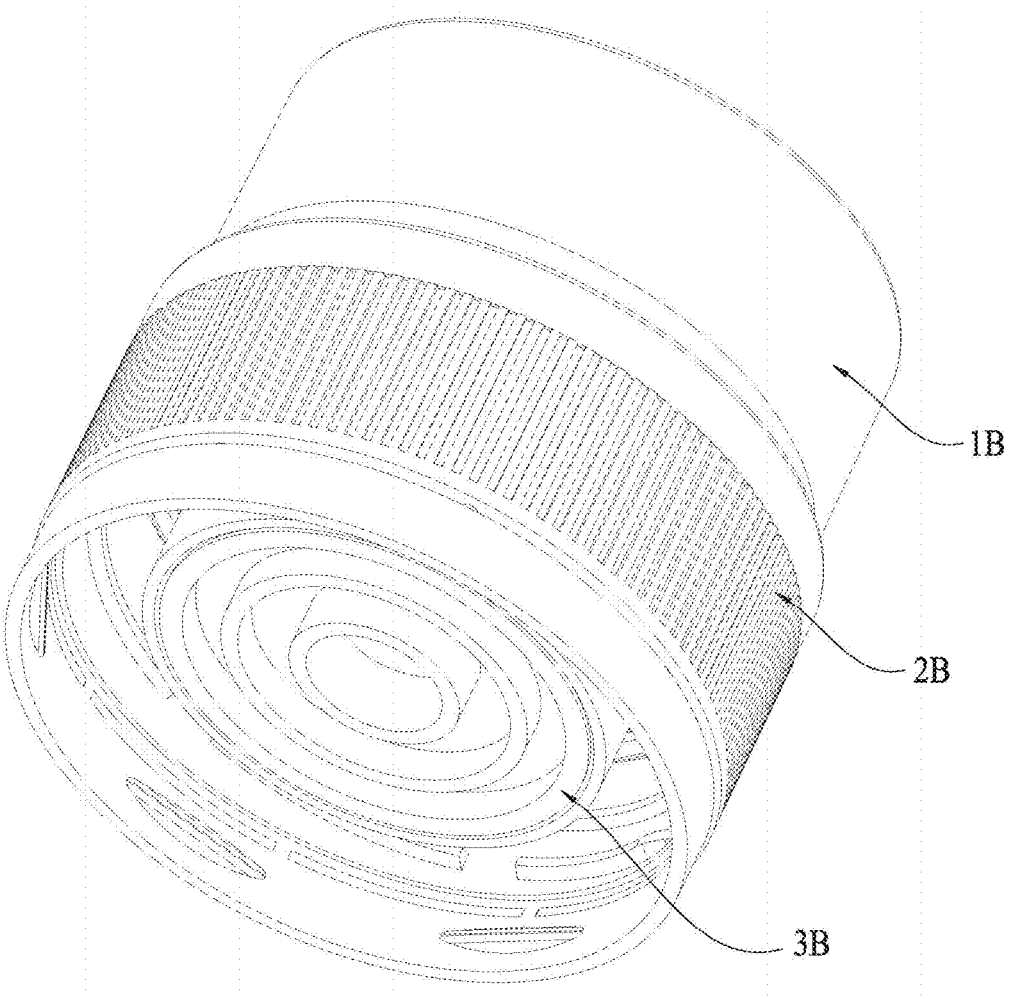
FIG. 5 is a stereo diagram of an instant-mix cap in accordance with a second embodiment of the present invention.
Figure 6:
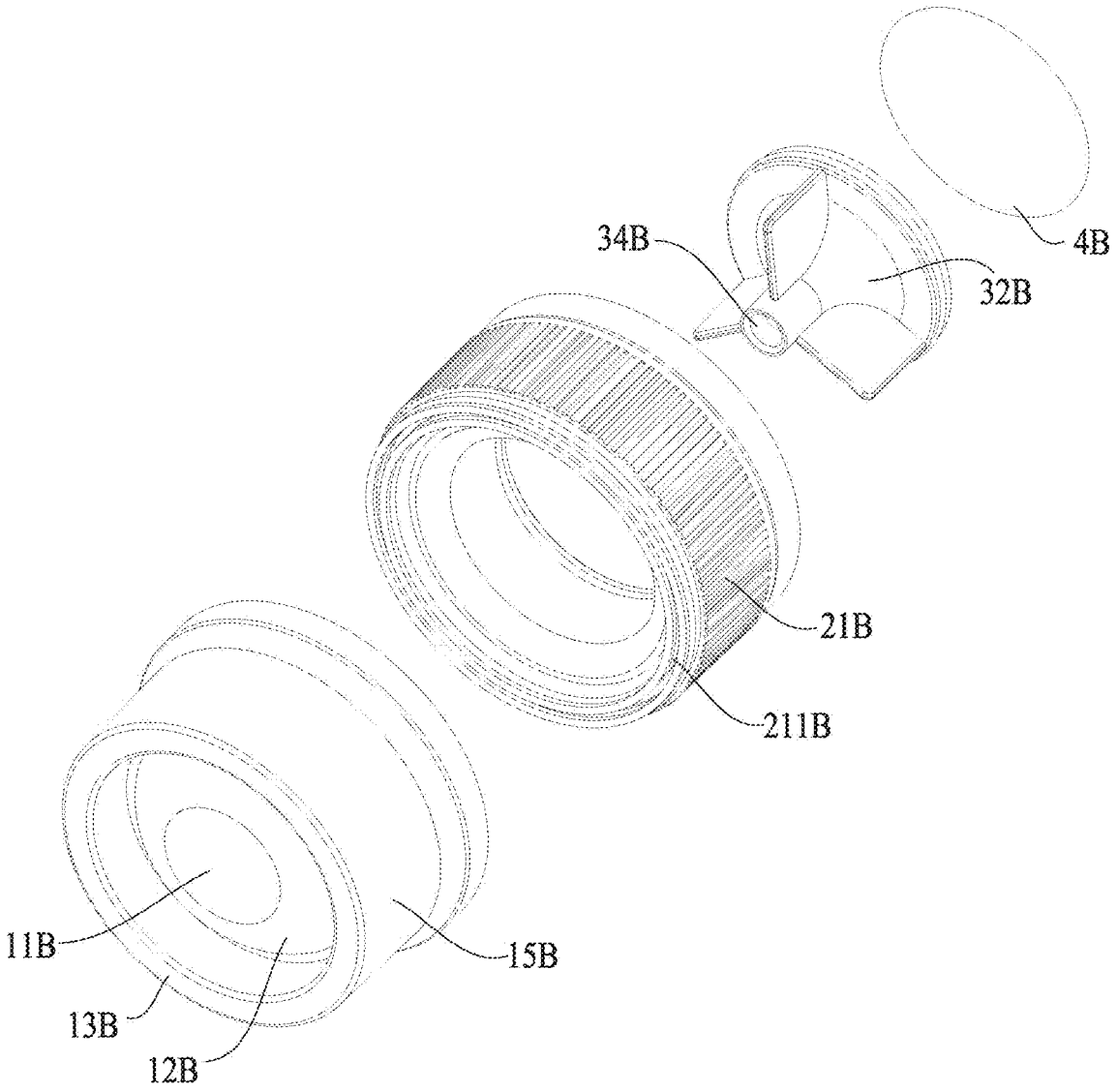
FIG. 6 is a first perspective exploded diagram of the instant-mix cap in accordance with the second embodiment.
Figure 7:
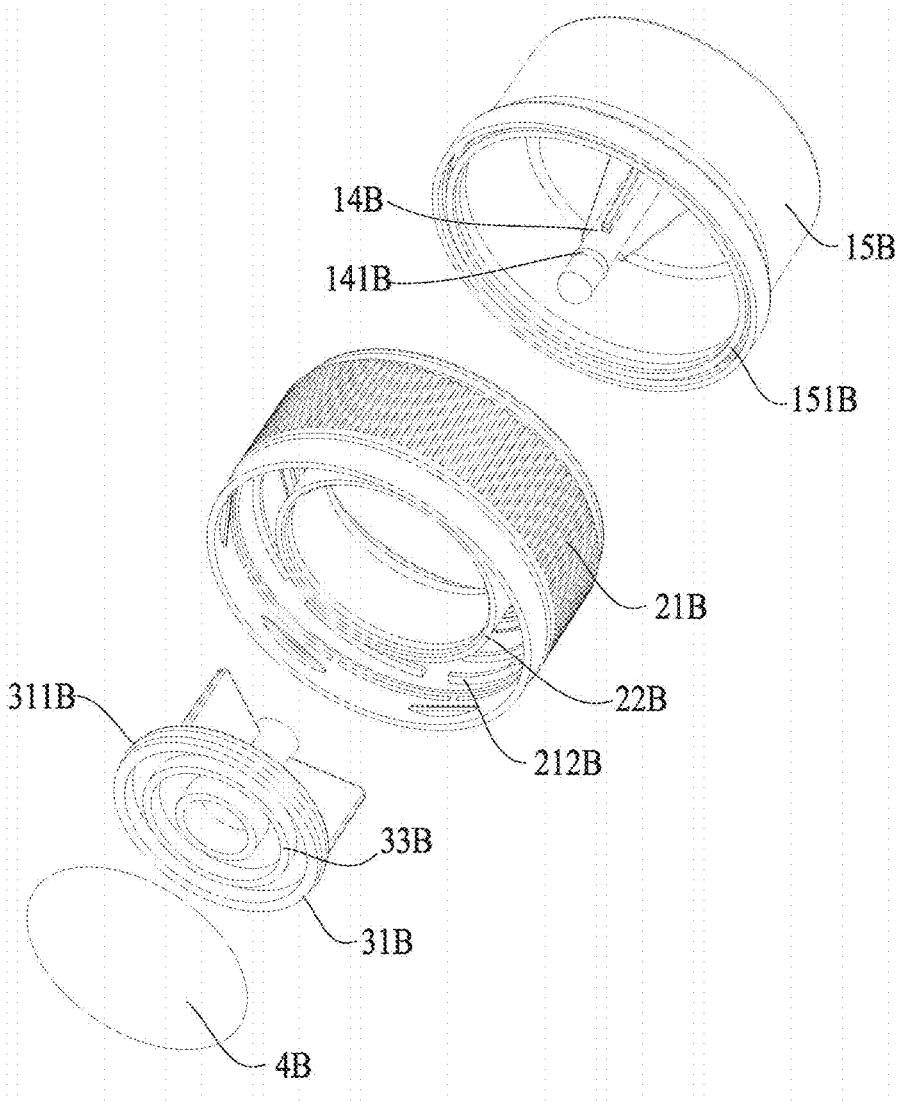
FIG. 7 is a second perspective exploded diagram of the instant-mix cap in accordance with the second embodiment.

Referring to FIGS. 1-4 shown, an instant-mix cap of present embodiment includes a cap body 1A and a sealing plug 2A. The cap body 1A and the sealing plug 2A are enclosed to form a sealed storage chamber 4A therebetween, which is used to store solute.

Specifically, the cap body 1A includes a pushing part 11A, an elastic part 12A, a protection part 13A, a pillar 14A and a cap cylinder 15A which are integrally formed together. An edge of the pushing part 11A extends outwardly to form the elastic part 12A, an edge of the elastic part 12A extends away from the direction of the storage chamber 4A, which forms the protection part 13A, and the protection part 13A is an annular cylinder structure, which is used to accommodate the pushing part 11A and the elastic part 12A. An upper end of the pillar 14A is vertically integral connected with a lower part of the pushing part 11A, and a lower end of the pillar 14A is engaged with the sealing plug 2A. A top of the cap cylinder 15A is integrally connected with the edge of the elastic part 12A, the axial direction of the cap cylinder 15A is opposite to the extended direction of the protection part 13A, a bottom of the cap cylinder 15A is open, the cap cylinder 15A is slidably and sealingly connected with the sealing plug 2A to form the storage chamber 4A therebetween. Specifically, the sealing plug 2A, the pushing part 11A, the elastic part 12A and the cap cylinder 15A form the sealed storage chamber 4A.

The pushing part 11A can drive the elastic part 12A to deform and move toward the inner of the storage chamber 4A under the action of an external force, the pillar 14A simultaneously pushes the sealing plug 2A to move downward, so that the sealing plug 2A is forced to be disconnected from the inner sidewall of a bottom of the cap cylinder 15A, thereby opening the storage chamber 4A.

In the embodiment, the elastic part 12A is made of flexible material, in the absence of an external force, the elastic part 12A is a curved convex structure due to its own elasticity, and the curved convex surface is upward, then elastic part 12A can be downward recessed when subjected to a downward application by an external force.

The instant-mix cap provided by present embodiment, only includes two injection molded parts: the cap body 1A and the sealing plug 2A. In this way, it can save one part, make the structure of the instant-mix cap be simpler, and reduce the production cost, and only one position where the sealing plug 2A and the cap cylinder 15A are connected needs to be sealed, reducing the difficulty of sealing.

In addition, as for the sealing plug structure used therein, the contact area between the plug ring of the sealing plug and the bottom end of the inner sidewall of the cap cylinder is small, therefore the friction force is small. When using this product, the storage chamber is opened by manually downward applying on the pushing part of the upper cap, the resistance for opening the storage chamber is minor, thus more saving labor and making operation smooth.

In present embodiment, a height of the protection part 13A is larger than a height of the pushing part 11A. The protection part 13A, the pushing part 11A, and the elastic part 12A are able to be molded in a single injection-mold process in production, without the need for additional protection parts for the pushing part 11A. The height of the protection part 13A is larger than the height of the pushing part 11A, thereby preventing unintentional or accidental contact the pushing part 11A with external forces during non-usage conditions, simplifying the structure of the instant-mix cap, saving the parts, and reducing the production costs of the instant-mix cap.

In present embodiment, the sealing plug 2A includes a plug ring 21A, a plug surface 22A, a plug bottom 23A and a snap-in hole 24A. The sealing plug 2A integrally is similar to a cone in the structure, the plug ring 21A is directly and sealingly connected to the bottom end of the inner sidewall of the cap cylinder 15A. One end of the sealing plug 2A which faces the storage chamber 4A is the plug surface 22A. The plug surface 22A is cone with an arc-shaped slope, a top of the cone is provided with the snap-in hole 24A, the pillar 14A of the cap body 1A is inserted into the snap-in hole 24A, and the plug bottom 23A is of a lightweight structure with multiple sleeved rings which are of different sizes, and bottoms of the multiple sleeved rings are in flush with each other, when the sealing plug 2A and the cap cylinder 15A are sealingly connected in the right position, the bottoms of the both are in flush state.

In present embodiment, an outer sidewall of the plug ring 21A is provided with an annular convex sealing line 211A which is an integrally formed with the plug ring 21A, a diameter of the annular convex sealing line 211A is slightly larger than an inner diameter of the cap cylinder 15A. The elasticity of the injection molded part forms an interference fit between the sealing plug 2A and the cap cylinder 15A, which can achieve better sealing effect.

In present embodiment, an inner sidewall of the snap-in hole 24A is provided with an annular groove 241A, and an outer sidewall of the lower part of the pillar 14A is provided with an annular protrusion 141A that engages with the annular groove 241A. By engaging the annular protrusion 141A with the annular groove 241A, a stronger and more stable insertion effect is achieved, so that the sealing plug 2A is not easy to fall off after the storage chamber 4A is opened. In some other embodiments, the concave-convex matching structure of the annular groove 241A and the annular protrusion 141A can also be reversely provided, that is, an annular protrusion is provided on the inner sidewall of the snap-in hole 24A, and an annular groove is provided on the outer sidewall of the lower part of the pillar 14A.

In present embodiment, the cap body 1A further includes a cap housing 16A, the cap housing 16A is integrally arranged on a periphery of the cap cylinder 15A, a connection groove is formed between the cap housing 16A and the cap cylinder 15A, and an inner sidewall of the cap housing 16A is provided with internal threads 161A for connecting with external threads of a bottle mouth. By inserting the bottle mouth into the connection groove, the bottle cap and the bottle mouth are connected by screwing and twisting.

In the above embodiment, the sealing plug 2A and the cap cylinder 15A are in a sliding sealing connection. Although the sealing plug 2A and the cap cylinder 15A are in interference fit, which can achieve a better sealing effect, in order to further enhance the sealing performance, the present embodiment is also provided with a sealing film 3A. Bottom surfaces of the sealing plug 2A and a cap cylinder 15A which are in flush with each other, can be welded with the sealing film 3A using ultrasonic or heating melt process to cover the gaps between the structural parts to achieve seamless and better sealing effect. Specifically, the sealing film 3A is made of a composite material with high barrier properties.

The working principle of the instant-mix cap in the first embodiment is as follows: turn the integrally formed cap body 1A upside down so that the opening at the bottom of the cap cylinder 15A faces upward, inject an appropriate amount of solute into the storage chamber 4A through this opening, and then assemble the plug surface 22A of the sealing plug 2A to the bottom of the cap cylinder 15A toward the storage chamber 4A, so that the pillar 14A of the cap body 1A is inserted into the snap-in hole 24A of the sealing plug 2A to form a firm snap connection. At the same time, the plug ring 21A of the sealing plug 2A is sealingly connected with the inner sidewall of the bottom of the cap cylinder 15A, thereby sealing the solute in the storage chamber 4A.

In order to further enhance the sealing performance, the lower surfaces of the sealing plug 2A and the cap cylinder 15A which are in flush with each other can be welded with the sealing film 3A by using ultrasonic or heating melt process to cover the gaps between the structural parts to achieve seamless and better sealing effect.

After the solute filling, assembly and sealing are completed for the instant-mix cap, the bottle is purified and filled with water, and the instant-mix cap is assembled on the bottle using an automatic capping process. The instant-mix cap and the bottle can be threadedly connected through the internal threads 161A and the external threads, and sealingly fit. The bottle completes the whole production, processing and assembly by using the present instant-mix cap.

During use, the user presses the pushing part 11A of the cap body 1A downward with fingers, pushes the pillar 14A to drive the sealing plug 2A to move downward, so that the sealing plug 2A is separated from the sealing blocking of the inner sidewall of the cap cylinder 15A, and at the same time the sealing film 3A is separated from the bottom of the cap cylinder 15A. However, it is still adhered to the plug bottom 23A of the sealing plug 2A and will not fall into the bottle, thereby opening the storage chamber 4A. The solute prefilled in the storage chamber 4A flows from the gap between the sealing plug 2A and the bottom of the cap cylinder 15A under the action of gravity, falls into the bottle and mixes with the water in the bottle to dissolve. It can be drunk after shaking to mix evenly or standing still for a period of time to fully dissolve.

In order to make full use of a diameter of the cap body 1A as the maximum diameter of the storage chamber 4A to expand the capacity of the storage chamber 4A of the instant-mix cap, while also preventing the cap cylinder 15A from protruding downward too much to reduce space occupation on the inside of the bottle and increase the water storage capacity of the bottle, the cap body 1A can be divided into two parts: an upper cap and a lower cap, thereby obtaining the following second embodiment and third embodiment of the present invention.

Second Embodiment

Referring to FIGS. 5-10, an instant-mix cap of present embodiment includes an upper cap 1B, a lower cap 2B and a sealing plug 3B. The upper cap 1B, the lower cap 2B and the sealing plug 3B are enclosed to form a sealed storage chamber 5B.

Specifically, the upper cap 1B includes a pushing part 11B, a curved flexible part 12B, an annular protection part 13B, a pillar 14B and an upper cap cylinder 15B which are integrally formed together. The annular protection part 13B is protruded upward and enclosed to be a protection area which is used for accommodating the pushing part 11B and the curved flexible part 12B. The pushing part 11B, the curved flexible part 12B and the annular protection part 13B are integrally connected, and a height of the annular protection part 13B is larger than a height of the pushing part 11B, so as to prevent an accidental contact to the pushing part 11B by an external force when not in use. The sealing plug 3B is removably sealingly connected to the bottom of the lower cap 2B for sealing the storage chamber 5B. The pillar 14B is integrally provided beneath the pushing part 11B. The upper cap cylinder 15B is integrally provided onto a bottom surface of the protection part 13B. The upper cap 1B has a structure in which a top of the upper cap 1B is closed and a lower end of the upper cap cylinder 15B is open.

The lower cap 2B includes a lower cap housing 21B and a lower cap cylinder 22B. The lower cap 2B is a cylindrical structure having openings at an upper and a lower end thereof, and the lower cap housing 21B is integrally covered onto the outside of the lower cap cylinder 22B. The present embodiment shows the upper cap 1B and the lower cap 2B which are connected in a sealed and fixed manner. Specifically, the upper cap cylinder 15B and the lower cap housing 21B are connected in a sealed and fixed manner by snapping.

Specifically, a lower end of the upper cap cylinder 15B is provided with an upper snap-in part 151B with double rings, and a snap-in gap is formed between the double rings of the upper snap-in part 151B; an upper end of the lower cap housing 21B is provided with a lower snap-in part 211B with double rings, a snap-in gap is formed between the double rings of the lower snap-in part 211B. The upper snap-in part 151B and the lower snap-in part 211B are two sealed snapping structures mated with each other, wherein the respective double rings thereof are alternately inserted into the snap-in gaps of the corresponding one. Annular protrusions T1 and annular grooves C1 correspondingly are provided on the upper snap-in part 151B and the lower snap-in part 211B, which are used to match and snap each other, in order to achieve a more sealing and firm snapping effect.

In the present embodiment, the sealing plug 3B is in sliding seal connection to the bottom of the lower cap cylinder 22B for sealing the storage chamber 5B; the upper end of the pillar 14B is integrally connected with the lower part of the pushing part 11B of the upper cap 1B, and its lower end is fixedly connected to the sealing plug 3B.

The sealing plug 3B in present embodiment includes a plug ring 31B, a plug surface 32B, a plug bottom 33B and a snap-in hole 34B. The connection relationship between the various components of the sealing plug 3B in present embodiment is the same as the connection relationship between various components in the sealing plug 2A in accordance with the first embodiment, and the connection relationship between the sealing plug 3B and the lower cap cylinder 22B is consistent with the connection relationship between the sealing plug 2A and the cap cylinder 15A, thus they will not be described again herein. Correspondingly, an inner sidewall of the snap-in hole 34B is provided with an annular groove 341B, and an outer sidewall of the pillar 14B is correspondingly provided with an annular protrusion 141B that cooperates with the annular groove 341B to achieve a stronger and more stable insertion effect, thereby making that the sealing plug 3B is not easy to fall off after the storage chamber 5B is opened. In some other embodiments, the concave-convex matching structure of the annular groove 341B and the annular protrusion 141B can also be reversely provided, that is, an inner sidewall of the snap-in hole 34B is provided with an annular protrusion, and an outer sidewall of the lower part of the pillar 14B is provided with an annular groove.

In addition, in order to improve the sealing performance between the sealing plug 3B and the lower cap cylinder 22B, the present embodiment is also provided with an integrally formed annular convex sealing line 311B on an outer sidewall of the plug ring 31B. A diameter of the annular convex sealing line 311B is slightly larger than an inner diameter of the lower cap cylinder 22B. The elasticity of the injection molded part forms an interference fit between the sealing plug 3B and the lower cap cylinder 22B to achieve a better sealing effect.

In present embodiment, the lower cap housing 21B is integrally covered onto an outside of the lower cap cylinder 22B, and a connecting groove is formed between the lower cap housing 21B and the lower cap cylinder 22B for inserting the mouth of the bottle into the connecting groove and fixedly connecting with the cap housing. At the same time, an inner sidewall of the lower cap housing 21B is provided with internal threads 212B, which facilitates the insertion of the bottle mouth into the connecting groove, and is threadedly connected through the external threads of the bottle mouth and the internal threads 212B of the lower cap housing 21B.

Figure 8:
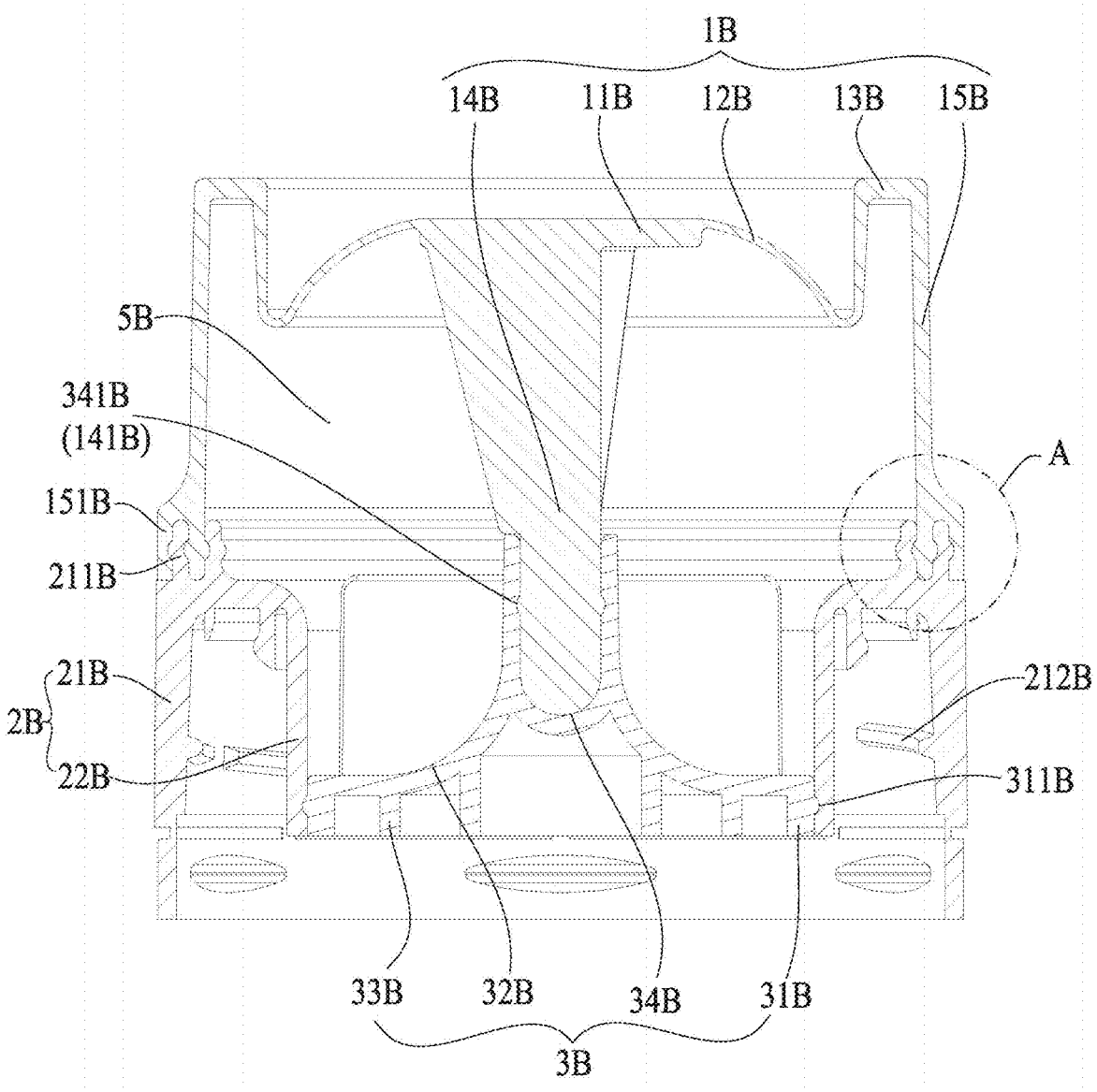
FIG. 8 is a cross-sectional diagram of one implementation of the instant-mix cap in accordance with the second embodiment.

It should be explained in particular that on the basis of second embodiment, as one kind of implementation, as shown in FIG. 8, the lower cap cylinder 22B is straight-cylindrical, and its inner diameter remains unchanged along its axial direction. The inner sidewall of the bottom of the lower cap cylinder 22B is sealing connection with sealing plug 3B. The straight-cylinder design makes a larger outlet formed by opening the sealing plug 3B, and is suitable for solute particles or viscous liquids with large filling volumes and poor fluidity, such as meal replacement powder, milk tea ingredients, honey, etc.

Figure 9:
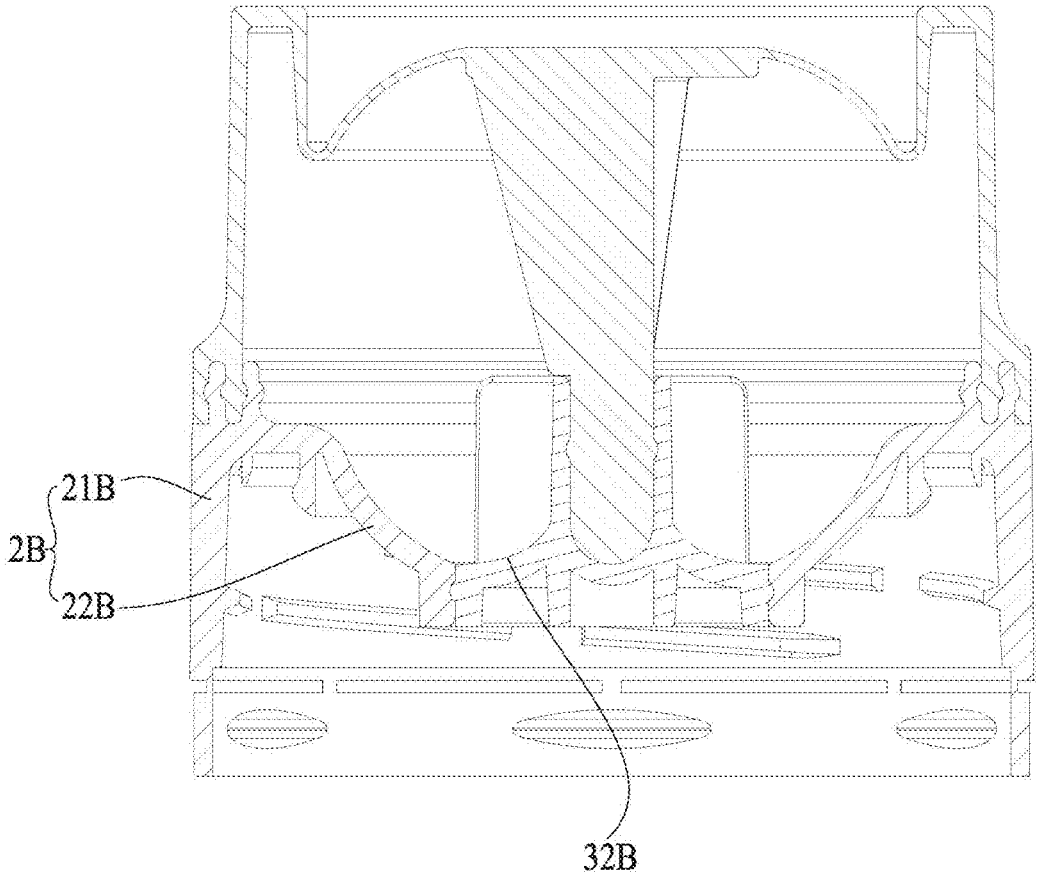
FIG. 9 is a cross-sectional diagram of another implementation of the instant-mix cap in accordance with the second embodiment.
Figure 10:
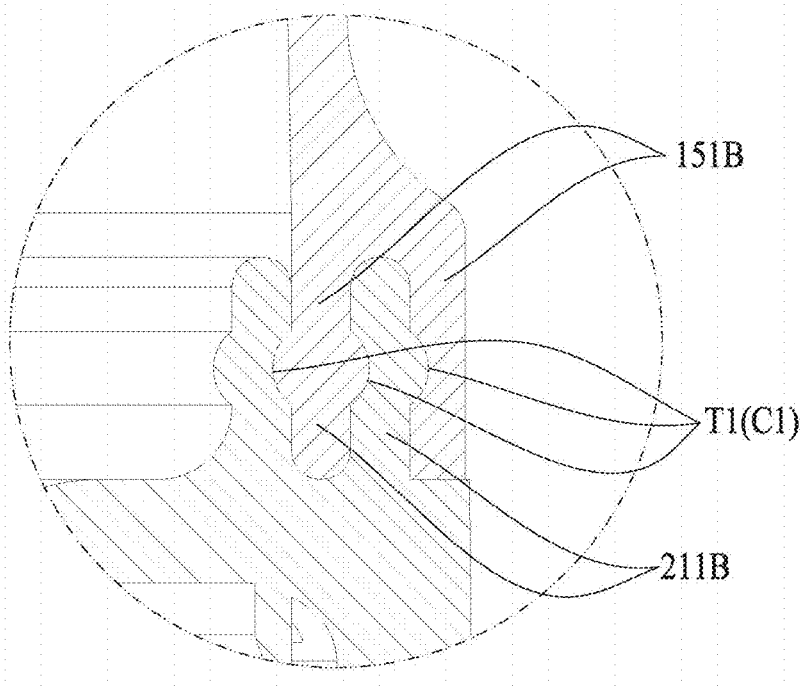
FIG. 10 is a partially enlarged diagram of a part A in FIG. 8.
Figure 11:
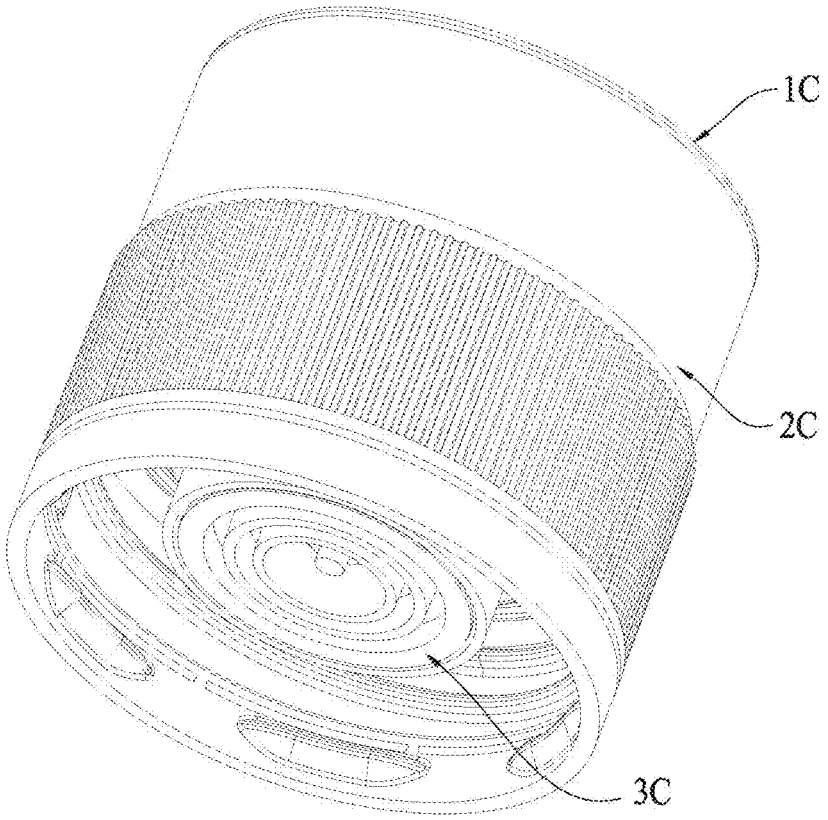
FIG. 11 is a stereo diagram of an instant-mix cap in accordance with a third embodiment of the present invention.
Figure 12:
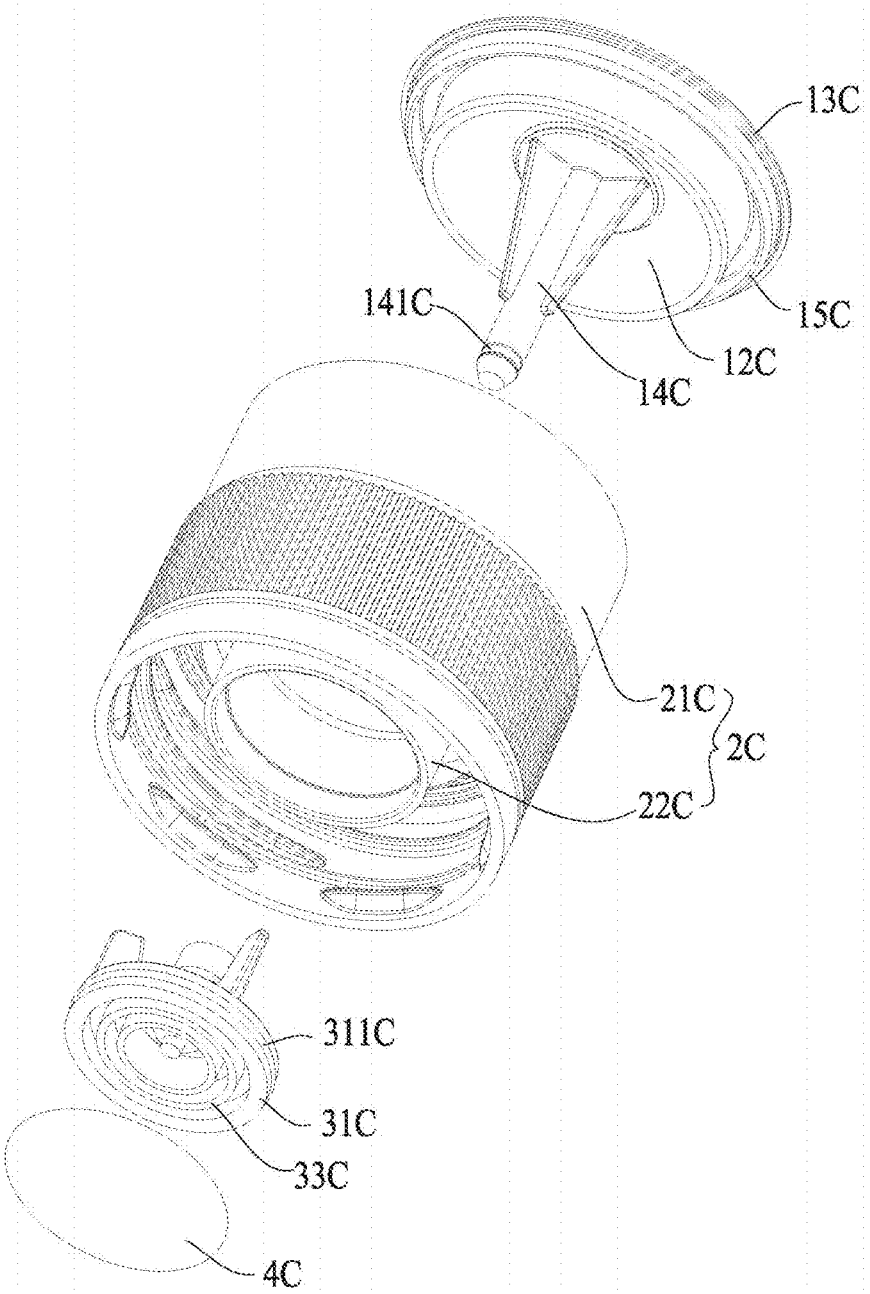
FIG. 12 is a first perspective exploded diagram of the instant-mix cap in accordance with the third embodiment.
Figure 13:
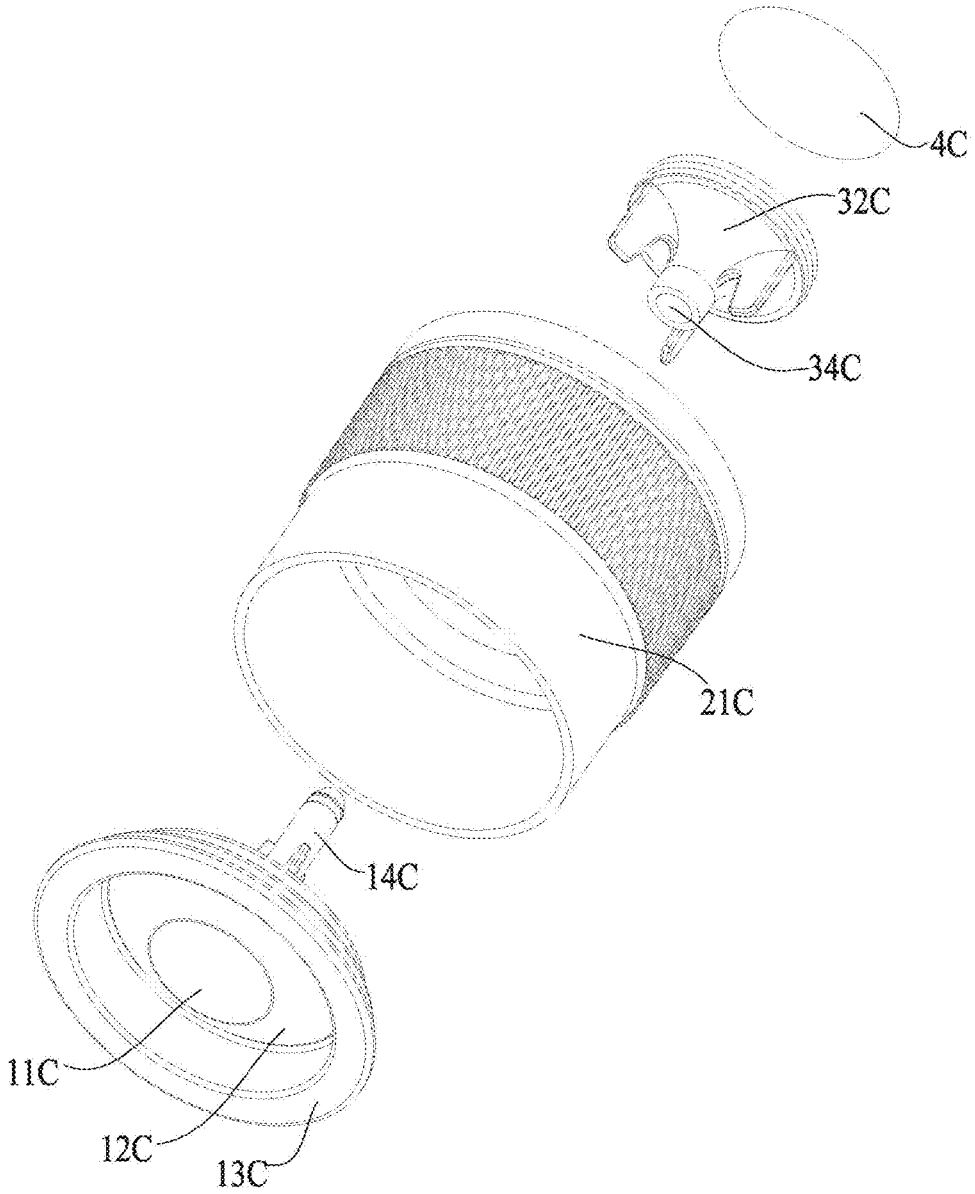
FIG. 13 is a second perspective exploded diagram of the instant-mix cap in accordance with the third embodiment.
Figure 14:
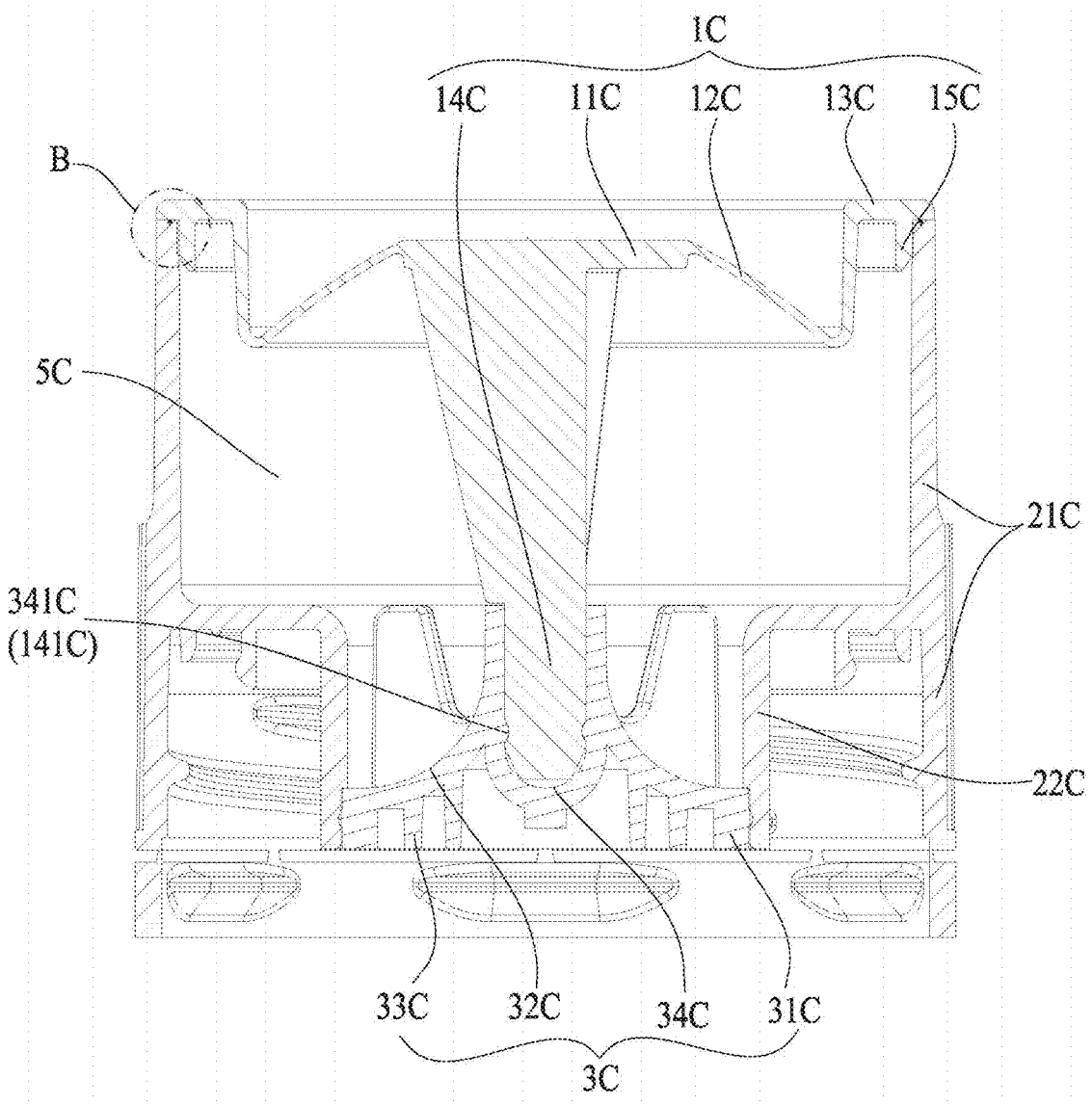
FIG. 14 is a cross-sectional diagram of the instant-mix cap in accordance with the third embodiment.
Figure 15:
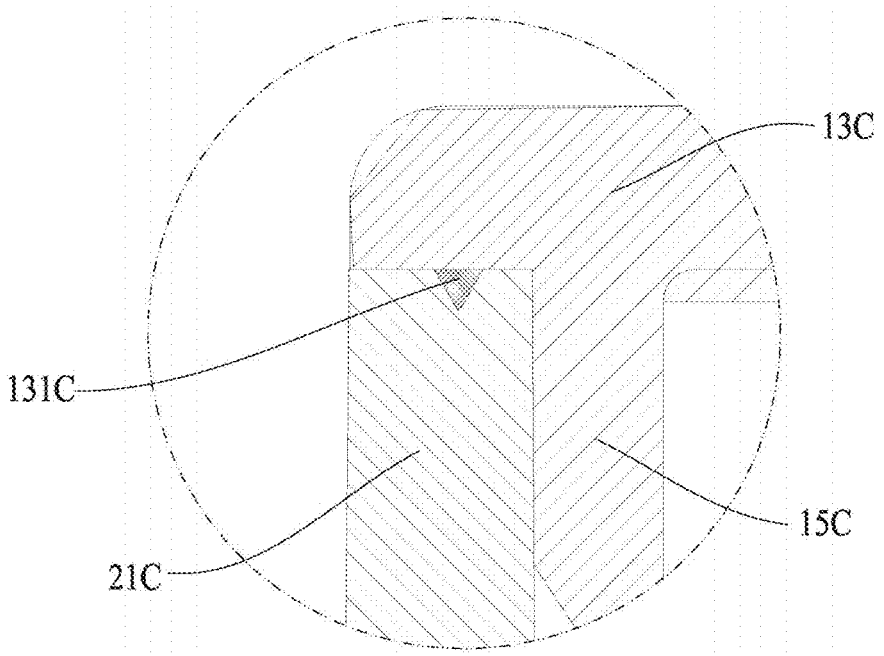
FIG. 15 is a partially enlarged diagram of a part B in FIG. 14.

As another implementation, referring to FIG. 9 shown, the lower cap cylinder 22B can also be provided in a funnel shape, with the inner diameter of cross section gradually decreases, and an inner sidewall of the bottom of the lower cap cylinder 22B is sealingly connected to the sealing plug 3B. The funnel-shaped design makes an outlet formed after the sealing plug 3B is opened, with an enhanced aesthetic appearance. This configuration is suitable for powdery solute particles or concentrated liquids with small filling volume and good fluidity, such as a freeze-dried tea powder, a freeze-dried coffee powder, and a tea concentrated liquid, a coffee concentrated liquid, etc.

In the second embodiment, in order to further enhance the sealing performance, lower surfaces of the sealing plug 3B and the lower cap cylinder 22B which are in flush with each other, can be welded with and the sealing film 4B by using an ultrasonic or heating melt process to cover the gaps between the structural components to achieve a seamless and better sealing effect.

The working principle of the instant-mix cap of the second embodiment is as follows: firstly, the upper cap 1B and the lower cap 2B are assembled together, and both of them are snapped together through their respective upper snap-in parts 151B and the lower snap-in parts 211B to form a sealed connection, and then an appropriate amount of solute is injected again into the storage chamber 5B, and then the sealing plug 3B is sealed and connected with the inner sidewall of the bottom of the lower cap cylinder 22B, thereby sealing the solute in the storage chamber 5B, and then the assembly of the instant-mix cap is finished. The installation of the instant-mix cap on the bottle and the operation of opening the storage chamber 5B in the second embodiment are the same as those in the first embodiment, and will not be described again herein.

In the second embodiment, although the upper cap and the lower cap are fixedly connected through double snap-in connections, the sealing requirement can be achieved to a certain extent. However, it cannot meet the complete sealing requirement, for example, when mechanical vibration occurs between the upper cap and the lower cap, there may be a problem of seal leakage at the connection. In response to the above problems, ultrasonic welding can achieve better sealing. However, in the second embodiment above, the connection between the upper cap and the lower cap is located in the middle of the entire bottle cap, and the connection between the upper cap and the lower cap is sealingly connected by ultrasonic welding, the welding spot is far away from the welding head, which is inconvenient for near-field welding, and the welding efficiency and quality are low, resulting in overall sealing performance of the instant-mix cap unstable. For this reason, the present application provides a new way of connection between the upper cap and the lower cap.

Third Embodiment

Referring to FIGS. 11-15, an instant-mix cap of the present embodiment includes an upper cap 1C, a lower cap 2C and a sealing plug 3C. The upper cap 1C, the lower cap 2C and the sealing plug 3C are enclosed to form a sealed storage chamber 5C.

Furthermore, the upper cap 1C includes a pushing part 11C, an elastic part 12C, a protection part 13C, a pillar 14C and an upper cap cylinder 15C which are integrally formed together. The protection part 13C is raised or protruded upward and enclosed to be a protection area which is used for accommodating the pushing part 11C and the elastic part 12C. The pushing part 11C and the protection part 13C are integrally fixedly connected by the elastic part 12C, and a height of the protection part 13C is larger than a height of the pushing part 11C, so as to prevent accidental contact to the pushing part 11C by external force when not in use. The pillar 14C is integrally provided beneath the pushing part 11C, and the upper cap cylinder 15C is fixedly provided on the bottom surface of the protection part 13C. The upper cap 1C has a structure in which the top of thereof is closed and the lower end of the upper cap cylinder 15C is open.

The lower cap 2C includes a lower cap housing 21C and a lower cap cylinder 22C. The lower cap 2C is a cylindrical structure with upper and lower openings, and the lower cap housing 21C is integrally covered onto the outside of the lower cap cylinder 22C. In present embodiment, the upper cap 1C and the lower cap 2C are connected in a sealed and fixed manner, therefore, the upper cap 1C, the lower cap 2C and the sealing plug 3C are enclosed to form the storage chamber 5C.

In present embodiment, the connection of the upper cap 1C and the lower cap 2C is realized by ultrasonic welding. Specifically, in the present embodiment, the top end of the lower cap housing 21C extends upward to form a cylindrical structure. In such arrangement, it can increase the volume of the storage chamber 5C. An inner sidewall of the lower cap housing 21C is connected to an outer sidewall of the upper cap cylinder 15C, a top surface of the lower cap housing 21C is connected to a bottom surface of the protection part 13C by ultrasonic welding.

Using the above technical solution, by inserting the upper cap cylinder 15C into the lower cap housing 21C, the outer sidewall of the upper cap cylinder 15C and the inner sidewall of the lower cap housing 21C are abutted against each other, so that radial positioning between the upper cover 1C and the lower cover 2C can be achieved. Ultrasonic welding is applied to the top surface of the protection part 13C. The welding position is located at the top of the entire bottle cap, which can reduce the inclination angle of the welding head. At the same time, the distance between the ultrasonic welding head and the welding position is reduced, enabling near-field welding, improving welding efficiency and quality, thus improving the overall sealing performance of the instant-mix cap.

As some better optimal embodiments, an energy directing bead 131C is integrally provided at the position where the bottom surface of the protection part 13C is abutted against the lower cap housing 21C. The energy directing bead 131C has a triangular longitudinal section. The energy directing bead 131C is used for fusing connection during ultrasonic welding, to achieve better welding results. During ultrasonic welding, the function of the energy directing bead 131C is to concentrate the vibration energy at the tip of the triangle, and then the accumulated heat forms a uniform plastic melt flow in the entire welding interface. It can increase the strength of the welding and reduce false welding, overflow and amplitude, improve the perfection degree of welded work-pieces, and even reduce processing time.

The sealing plug 3C in this embodiment includes a plug ring 31C, a plug surface 32C, a plug bottom 33C and a snap-in hole 34C. The connection relationship among the various components of the sealing plug 3C in present embodiment is the same as the connection relationship among the various components of the sealing plug 3B involved in the second embodiment. Correspondingly, the connection relationship between the sealing plug 3C and the lower cap cylinder 22C is consistent with the connection relationship between the sealing plug 3B and the lower cap cylinder 22B in the second embodiment, which will not be described again herein. Correspondingly, an inner sidewall of the snap-in hole 34C is provided with an annular protrusion 341C, and an outer sidewall of the pillar 14C is correspondingly provided with an annular groove 141C that cooperates with the annular protrusion 341C to achieve a more secure and stable plug-in effect, thereby making the sealing plug 3C not easy to fall off, after the storage chamber 50 is opened. In some other embodiments, the concave-convex matching structure of the annular protrusion 341C and the annular groove 141C can also be reversely provided, that is, an inner sidewall of the snap-in hole 34C is provided with an annular groove, and an outer sidewall of the lower part of the pillar 14C is provided with an annular protrusion.

In addition, in order to improve the sealing performance between the sealing plug 3C and the lower cap cylinder 22C, the present embodiment is also provided with an integrally formed annular convex sealing line 311C on an outer sidewall of the plug ring 31C. A diameter of the annular convex sealing line 311C is slightly larger than the inner diameter of the lower cap cylinder. The elasticity of the injection molded part forms an interference fit between the sealing plug 3C and the lower cap cylinder 22C to achieve a better sealing effect.

In the present embodiment, the lower surfaces of the sealing plug 3C and the lower cap cylinder 22C which are in flush with each other can be welded with the sealing film 4C by using an ultrasonic or heating melt process to cover the gaps between the structural components to achieve a seamless and better sealing effect. Specifically, the sealing film 4C is made of a composite material with high barrier properties.

In the present embodiment, the lower cap housing 21C is integrally covered onto an outside of the lower cap cylinder 22C, and a bottle mouth connection groove is formed between the lower cap housing 21C and the lower cap cylinder 22C for inserting the bottle mouth of the bottle into the bottle mouth connection groove, and being fixedly connected with the cap housing. At the same time, an inner sidewall of the lower cap housing 21C is provided with internal threads 212C, which facilitates the insertion of the bottle mouth of the bottle into the bottle mouth connection groove, and is threadedly connected through the external threads of the bottle mouth and the internal threads of the lower cap housing 212C.

It should be noted that the lower cap cylinder 22C in present embodiment can be provided as a straight-cylinder shape or a funnel shape, and its function is the same as that of the lower cap cylinder 22B in the second embodiment.

The upper cap 1C and the lower cap 2C in the third embodiment are sealed and connected by welding. The sealing installation method of the sealing plug 3C in the lower cap 2C is the same as that in the second embodiment. At the same time, the assembly of the bottle with the instant-mix cap, and opening methods of the storage chamber 5C in the third embodiment are also the same as those in the second embodiment, and will not be described again herein.

What is claimed is:

1. An instant-mix cap, comprising a cap body, a sealing plug, and a sealing film, wherein the cap body and the sealing plug are enclosed to form a sealed storage chamber; wherein the cap body comprises a pushing part, an elastic part, a protection part, a pillar and a cap cylinder which are integrally formed together; wherein an edge of the pushing part extends outwardly to form the elastic part, and an edge of the elastic part extends away from a direction of the storage chamber, and protrudes to form the protection part; wherein a height of the protection part is larger than a height of the pushing part in order to prevent accidental contact to the pushing part by external force when it is not in use; wherein the pillar is provided beneath the pushing part, a lower end of the pillar is engaged with the sealing plug; wherein a top of the cap cylinder is integrally connected with the edge of the elastic part, and a bottom of the cap cylinder is open, and is slidably and sealingly connected with the sealing plug to form the storage chamber; wherein the pushing part is configured to drive the elastic part to deform and move downward under an external force, and the pillar synchronously pushes the sealing plug to move downward, so that the sealing plug is forced to be disconnected from the bottom of the cap cylinder, thereby opening the storage chamber; and wherein the sealing film is made of a composite material with high barrier properties and is covered onto bottom surfaces of the sealing plug and the cap cylinder which are in flush with each other, said sealing film attached by heat sealing or ultrasonic welding process.

2. The instant-mix cap of claim 1, wherein the cap body further comprises a cap housing arranged on a periphery of the cap cylinder,;

wherein a bottle mouth connection groove is formed between the cap housing and the cap cylinder, and an inner sidewall of the cap housing is provided with internal threads for connecting with external threads of a bottle mouth.

3. The instant-mix cap of claim 2, wherein the sealing plug comprises a plug ring, a plug surface, a plug bottom, and a snap-in hole which are integrally formed together;

wherein the plug ring is disposed on a periphery of the plug surface and is sealingly connected to an inner sidewall of a bottom of the cap cylinder;

wherein the plug surface faces the storage chamber, and the plug surface is provided with the snap-in hole;

wherein a bottom of the pillar is inserted into the snap-in hole,; wherein an inner sidewall of the snap-in hole is provided with an annular groove, and an outer sidewall of the bottom of the pillar is provided with an annular protrusion that engages with the annular groove;

wherein an outer sidewall of the plug ring is provided with an integrally formed annular convex sealing line, and a diameter of the annular convex sealing line is larger than an inner diameter of the cap cylinder.

4. An instant-mix cap, comprising:

an upper cap, a lower cap and a sealing plug;

wherein the upper cap, the lower cap and the sealing plug are enclosed to form a sealed storage chamber;

wherein the upper cap comprises a pushing part, a curved flexible part, an annular protection part, a pillar, an upper cap cylinder and an annular upper snap-in part which are integrally formed together;;

wherein the annular protection part protrudes upward and encloses to form a protection area accommodating the pushing part and the curved flexible part, and a height of the annular protection part is larger than a height of the pushing part; wherein the sealing plug is removably and sealingly connected to a bottom of the lower cap for sealing the storage chamber;

wherein the pillar is integrally provided beneath the pushing part of the upper cap, and a lower end of the pillar is fixedly connected to the sealing plug; when manually acting downward on the pushing part, the curved flexible part deforms and moves downward, and the pillar synchronously pushes the sealing plug downward to disengage the sealing plug from the lower cap, thereby opening the storage chamber;

wherein the lower cap comprises a lower cap housing, a lower cap cylinder and an annular lower snap-in part; wherein the upper cap has a structure of being closed at a top thereof with an opening at a lower end of the upper cap cylinder; wherein the lower cap is of a cylinder structure having openings at an upper end and a lower end thereof, and the lower cap housing is integrally formed with and surrounds the lower cap cylinder; wherein the upper cap and the lower cap are sealingly engaged by the annular upper snap-in part and the annular lower snap-in part, therefore enclosing to form the storage chamber;

wherein a lower end of the upper cap cylinder is provided with the upper snap-in part with double rings, and a snap-in gap is formed between the double rings of the upper snap-in part; wherein a top end of the lower cap housing is provided with the lower snap-in part with double rings, a snap-in gap is formed between the double rings of the lower snap-in part, the upper snap-in part and the lower snap-in part are alternately inserted into the snap-in gaps; and wherein an annular protrusion and an annular groove are correspondingly provided on the upper and lower snap-in parts, and the annular protrusion and the annular groove match each other to form a sealing structure.

5. The instant-mix cap of claim 4, wherein the lower cap cylinder is of a cylinder structure with upper and lower openings;

wherein the lower cap housing is integrally covered onto the lower cap cylinder, and a bottle mouth connection groove is formed between them;

wherein an inner sidewall of the lower cap housing is provided with internal threads for connecting with external threads of a bottle mouth;

wherein the sealing plug comprises a plug ring, a plug surface, a plug bottom and a snap-in hole; wherein the plug ring is directly sealingly connected to a bottom end of an inner sidewall of the lower cap cylinder; wherein an end facing the storage chamber is the plug surface, which is a cone with an arc-shaped slope, a top of the cone is provided with the snap-in hole; wherein the pillar of the upper cap is inserted into the snap-in hole; and wherein an annular protrusion and an annular groove are correspondingly formed on an inner sidewall of the snap-in hole and the an outer sidewall of the pillar.

6. An instant-mix cap, comprising:

an upper cap, a lower cap and a sealing plug; wherein the upper cap, the lower cap and the sealing plug are enclosed to form a sealed storage chamber;

wherein the upper cap comprises a pushing part, an elastic part, a protection part, an upper cap cylinder and a pillar which are integrally formed together;

wherein an edge of the pushing part extends outward and forms the elastic part, an edge of the elastic part extends away from a direction of the storage chamber, and protrudes to form the protection part, and a height of the protection part is larger than a height of the pushing part;

wherein the pillar is provided beneath the pushing part below, and a lower end of the pillar is engaged with the sealing plug;

wherein an inner side of an edge of the protection part extends toward the direction of the storage chamber to form the upper cap cylinder;

wherein the lower cap comprises a lower cap cylinder and a lower cap housing; wherein the lower cap cylinder is integrally covered onto the lower cap housing; a bottom of the lower cap cylinder is engaged with the sealing plug; an inner sidewall of the lower cap housing is connected to an outer sidewall of the upper cap cylinder, a top surface of the lower cap housing is abutted against a bottom surface of the protection part, and the connection between these surfaces is sealed and connected by ultrasonic welding;

wherein the pushing part is configured to drive the elastic part to deform and move downward under an external force, and the pillar synchronously pushes the sealing plug to move downward, causing the sealing plug to break the connection with the bottom of the lower cap cylinder, thereby opening the storage chamber; and wherein an energy directing bead is provided at a location where the bottom surface of the protection part is abutted against the lower cap housing, and a longitudinal section of the energy directing bead is triangular.

7. The instant-mix cap of claim 6, wherein a bottle mouth connection groove is formed between the lower cap housing and the lower cap cylinder, and the inner sidewall of the lower cap housing is provided with internal threads for connecting with external threads of a bottle mouth;

wherein the sealing plug comprises a plug ring, a plug surface, a plug bottom and a snap-in hole which are integrally formed;

wherein the plug ring is provided on a periphery of the plug surface, and the plug ring is sealingly connected to an inner sidewall of the bottom of the lower cap cylinder; wherein the plug surface faces the storage chamber, the snap-in hole is provided on the plug surface, and a bottom of the pillar is inserted into the snap-in hole;

wherein an inner sidewall of the snap-in hole is provided with an annular groove, and an outer sidewall of the bottom of the pillar is provided with an annular protrusion, and the annular protrusion is engaged with the annular groove;

wherein an outer sidewall of the plug ring is provided with an integrally formed annular convex sealing line, and a diameter of the annular convex sealing line is larger than an inner diameter of the cap cylinder.

8. The instant-mix cap of claim 6, wherein the instant-mix cap further comprises a sealing film;

wherein the sealing film is made of a composite material with high barrier properties and is covered onto bottom surfaces of the sealing plug and the lower cap cylinder, which are in flush with each other, by heat sealing or ultrasonic welding process, in order to completely cover a structural gap between the sealing plug and the bottom of the lower cap cylinder.

* * * * *